US006602146B1

(12) United States Patent
Pirre

(10) Patent No.: US 6,602,146 B1
(45) Date of Patent: Aug. 5, 2003

(54) PUTTING SKILL GAME

(76) Inventor: John Pirre, 136 Cold Spring Rd., Stamford, CT (US) 06905

( * ) Notice: Subject to any disclaimer, the term of this patent is extended or adjusted under 35 U.S.C. 154(b) by 271 days.

(21) Appl. No.: 09/591,403

(22) Filed: Jun. 12, 2000

(51) Int. Cl.[7] ..... A63B 69/00

(52) U.S. Cl. ..... 473/221; 473/219; 473/220; 473/222; 273/317.2; 273/108.2

(58) Field of Search ..... 273/317.2, 108.2; 473/131, 406, 407, 219–222

(56) References Cited

U.S. PATENT DOCUMENTS

| | | | | |
|---|---|---|---|---|
| 4,063,259 A | * 12/1977 | Lynch et al. | 354/120 |
| 4,327,917 A | 5/1982 | Bagley | 273/176 FA |
| 4,858,922 A | 8/1989 | Santavaci | 273/26 R |
| 4,872,687 A | 10/1989 | Dooley | 273/185 R |
| 5,067,718 A | 11/1991 | Knox et al. | 273/185 R |
| 5,169,150 A | * 12/1992 | Tindale | 273/187.4 |
| 5,169,151 A | * 12/1992 | Conley | 273/186.2 |
| 5,174,574 A | 12/1992 | Knox et al. | 273/179 B |
| 5,181,721 A | 1/1993 | Halliburton | 273/177 A |
| 5,390,927 A | 2/1995 | Angelos | 273/185 A |
| 5,860,648 A | 1/1999 | Petermeier et al. | 273/108.2 |
| 6,213,887 B1 * | 4/2001 | Carney | 473/183 |

* cited by examiner

*Primary Examiner*—S. Thomas Hughes
*Assistant Examiner*—Carmen D. White
(74) *Attorney, Agent, or Firm*—St. Onge Steward Johnston & Reens LLC

(57) ABSTRACT

A putt trainer system includes a plurality of ball sensors, each having a lever which pivots at impact with a putted golf ball between a rest position, wherein it blocks a light beam from a light source, and a deflected position. The light beam passes through a recess of predetermined length made in the lever to be detected by a light sensor generating a detection signal of predetermined duration that is compared with a preset value corresponding to a maximum acceptable speed. If the detection signal is at most equal to the preset value, it is further evaluated to determine whether this signal represents an off-centered, partially centered, or centered putt, each of which is allocated a respective score.

3 Claims, 5 Drawing Sheets

PUTTING SKILL GAME

FIELD OF THE INVENTION

This invention relates to a portable golf game system for playing and practicing a game of golf in a home and/or outdoor environment. Particularly, the invention relates to an electronically operating system that senses a golf ball directed by a player who strikes a putt at a target area exactly simulating the diameter of a hole on the putting green of a golf course. Specifically, the invention relates to an electronically operating game system wherein striking a putt influences a game score indicative of the player's performance which is based on the accuracy of the player's putt and ball's velocity.

BACKGROUND OF THE INVENTION

A game of golf has evolved in one of the most popular sports. A development of golf techniques is highly rewarding in terms of lower scores and therefore greater enjoyment of the game. A key to accomplish this, of course, is to know how to hit a golf ball correctly, because golf belongs to a category of technical sports that requires high technical skills without which even the most physically gifted athlete is doomed for failure. On a real golf course where the distances between the start area and the objective hole are frequently as much as several hundred meters the strokes played by the players are of two kinds. Firstly, long-distance strokes are called "swings" or "long drives" where the player attempts to get the ball close to the hole, covering the greatest possible distance, possibly tens or even hundreds of yards. Secondly, precision strokes or "putts" where the player attempts to directly hole the putt from a distance that rarely exceeds a few feet.

While there are as many different styles of putting as there are players, certain principles have been established. Thus, one of the principles is that the ace of the club should be square to the intended line when the ball is struck. The second basic principle of effective putting is that the ball should be struck solidly with the putter, meaning that the center of the clubface should hit the center of the back of the ball. This, however, presupposes that the center of the clubface also is the center of its gravity.

The reason a solid blow is required is that it is the only type that can be relied on to consistently produce the power needed for a given amount of distance. If, for instance, a player swings the club head just fast enough to propel the ball 20 feet with a solid blow, an off-center blow will leave the ball up to 6 feet short of that distance, depending on the degree of error. Thus, the sense of ball velocity is the basis of hitting a golf ball correctly so it can reach the hole and either go in or stop not more than a few inches. As a consequence, the only factors in having a golf ball successfully reach the hole are the path and angle of the clubface determining direction of the ball at impact and a speed at which the golf ball travels.

Obviously, to consistently hit the ball solidly at a predetermined speed and to have the clubface travelling along a trajectory conductive to desirable distance a player has to repeat the strokes endlessly that may decrease the player's interest in developing the putt swing indispensable to the successful game. Recognizing a need in providing long hours of practice more entertaining for both, the beginners and seasoned golfers, a variety of golf games have been made.

U.S. Pat. No. 3,114,554 describes a track for training in putting with a plurality of holes which are opened one at a time in sequence. Control devices are provided to react to entry of a ball into an open hole, to open the next hole in the sequence and to display the results.

U.S. Pat. No. 3,684,293 describes a tunnel-like cage. The walls of the cage, and in particular the back wall, comprise coatings selected to damp impact in a particular way. In this way it should be possible to evaluate the length of the swing and the effects imparted to the ball. As an accessory there is provision for training in putting by placing a hole in the cage.

U.S. Pat. No. 4,045,023 describes a device for training swinging which essentially comprises at a distance from a starting base a target provided with impact sensors and divided widthwise and heightwise in sectors. The division into widthwise sectors corresponds to the accuracy of the stroke in terms of direction while the heightwise division is used to evaluate the theoretical range of the stroke.

Many of these known devices may be prohibitively expensive and require a large space. Also, at least some of these devices are not designed to either improve the accuracy of putt in accordance with a skill level of player or control velocity of a golf ball during a putting exercise.

SUMMARY OF THE INVENTION

A putt trainer system in accordance with this invention achieves these goals by providing players who have different skill levels with a device capable of evaluating a speed of a golf ball, its direction and a score representing the accuracy of a putt.

According to one aspect of the invention, the putt trainer system has a simple mechanical compact structure so the putt system can be conveniently used even in a small urban apartment. Particularly, the putt trainer system includes a series of levers pivotally mounted in a housing that is connected to a weight support by a first shaft. The weight's support is sized and shaped so that the entire structure remains stable regardless of the ball's velocity. The levers, in turn, pivot about a second shaft to activate sensors capable of detecting a rate at which a lever struck by a ball deflects.

In accordance with another aspect of the invention, the putt trainer system has a control system which is capable of evaluating a rate at which a lever is displaced. As a consequence, the velocity of ball is determined and then compared with a reference value. If the determined velocity exceeds the reference value, no score will be assigned to a particular putt, since a comparator does not generate an outcome signal. It is essential for a golf player to be in control of his/her stroke since an excessive force applied to the ball can detrimentally affect the precision of a putt.

For instance, a putt struck at a velocity that would have gone approximately 2 to 3 feet past the hole for an off-center hit would not be holed; yet the same putt would have been holed for a center putt.

The putt trainer system includes a combination of analog and digital components and is not limited to any particular circuitry. While the preferred embodiment has a part of the circuitry consisting of analog components, the scope of this invention does not exclude a circuitry including only digital components.

A further aspect in accordance with invention is the ability of the putt trainer system to decode the accuracy of a putt by discriminating between a fully centered putt, an off-centered putt and a partially centered putt which are represented by respective discrimination signals.

In accordance with still another aspect of the invention, the putt trainer system includes a weighting counter evaluating the discrimination signals with predetermined weighting factors to obtain a score, which is displayed on a screen.

It is therefore an object of the invention to provide a portable putt trainer system effectively improving a putt swing and providing an entertaining game for at least one player.

Still another object of the invention is to provide a putt trainer system which has a simple and inexpensive structure.

Still a further object of the invention is to provide a putt trainer system determining a velocity of the putted golf ball and upon comparison with a preset value either allowing or disallowing a score.

A further object of the invention is to provide a putt trainer system capable of allocating a score to differently aimed putts in order to provide a competitive environment for a few players.

BRIEF DESCRIPTION OF THE DRAWINGS

The above and other objects, features and advantages will become more readily apparent from the following description of the preferred embodiment of the invention accompanied by a set of drawings, in which.

DETAILED DESCRIPTION OF THE DRAWINGS

Figure 1:
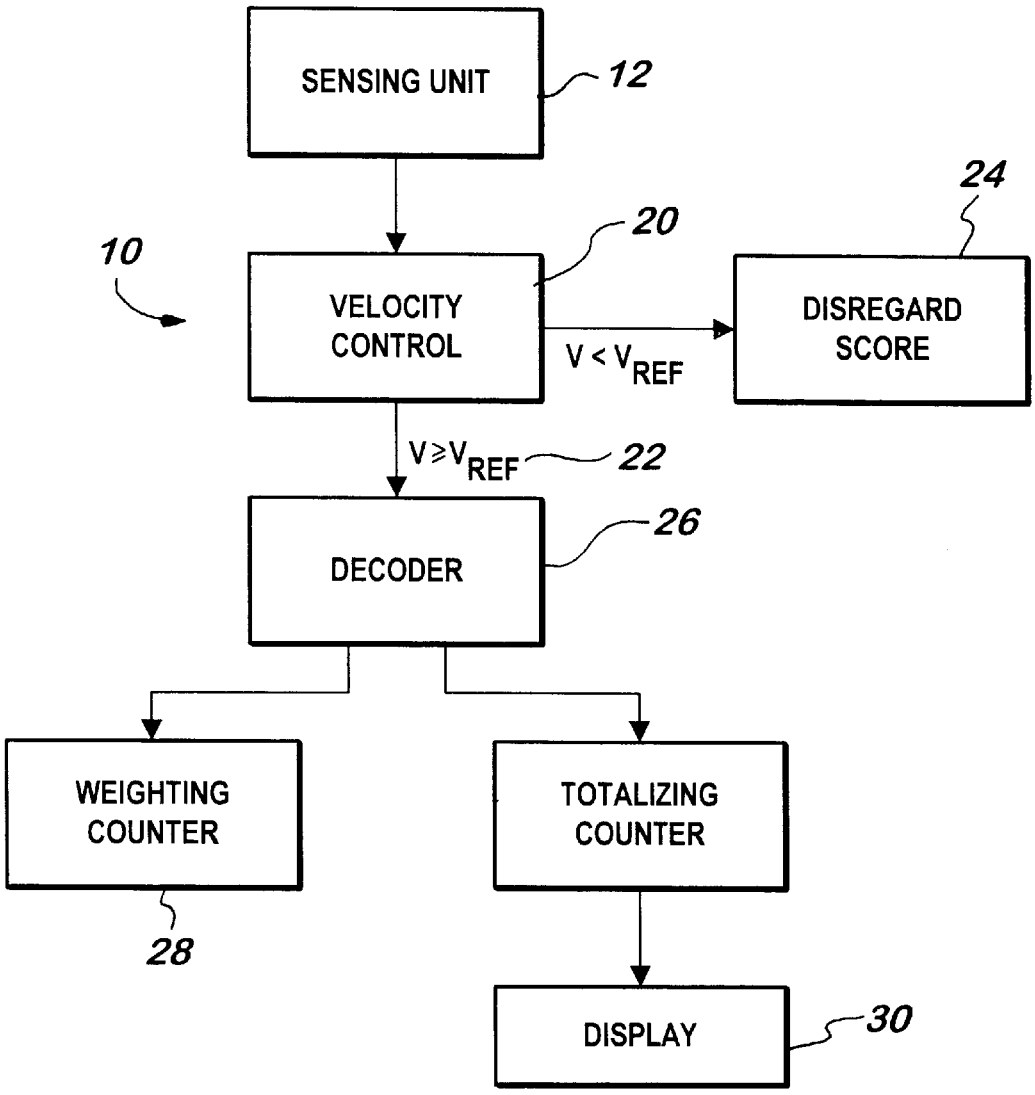
FIG. 1 is a flow chart diagram illustrating a basic concept of the invention.

Referring to FIG. 1 a simplified block diagram of the a putt trainer system 10 includes a sensing unit 12 having ball sensors for centered and off-centered putts, each, of which generates putting detection signals representing detection of a putting ball at impact with a respective lever. A putting detection signal is first evaluated by a velocity controller 20, which is set to compare the detection signal carrying the information regarding the ball's speed with a reference value at 22. If, upon comparison, the detected speed is higher than the reference value, a game is immediately interrupted at 24 and is reset to evaluate a subsequent putt. If, however, the detected speed is at most equal to the reference value, an enabling signal at the output of the velocity controller activates an accuracy decoder 26 generating a discrimination signal, which represents centered, off-centered, and/or partially centered putts.

Each of the discrimination signals is evaluated by a weighting counter 28 with predetermined weighting factors, each representing the centered, off-centered and partially centered putts to obtain a score displayed at 30.

Figure 2:
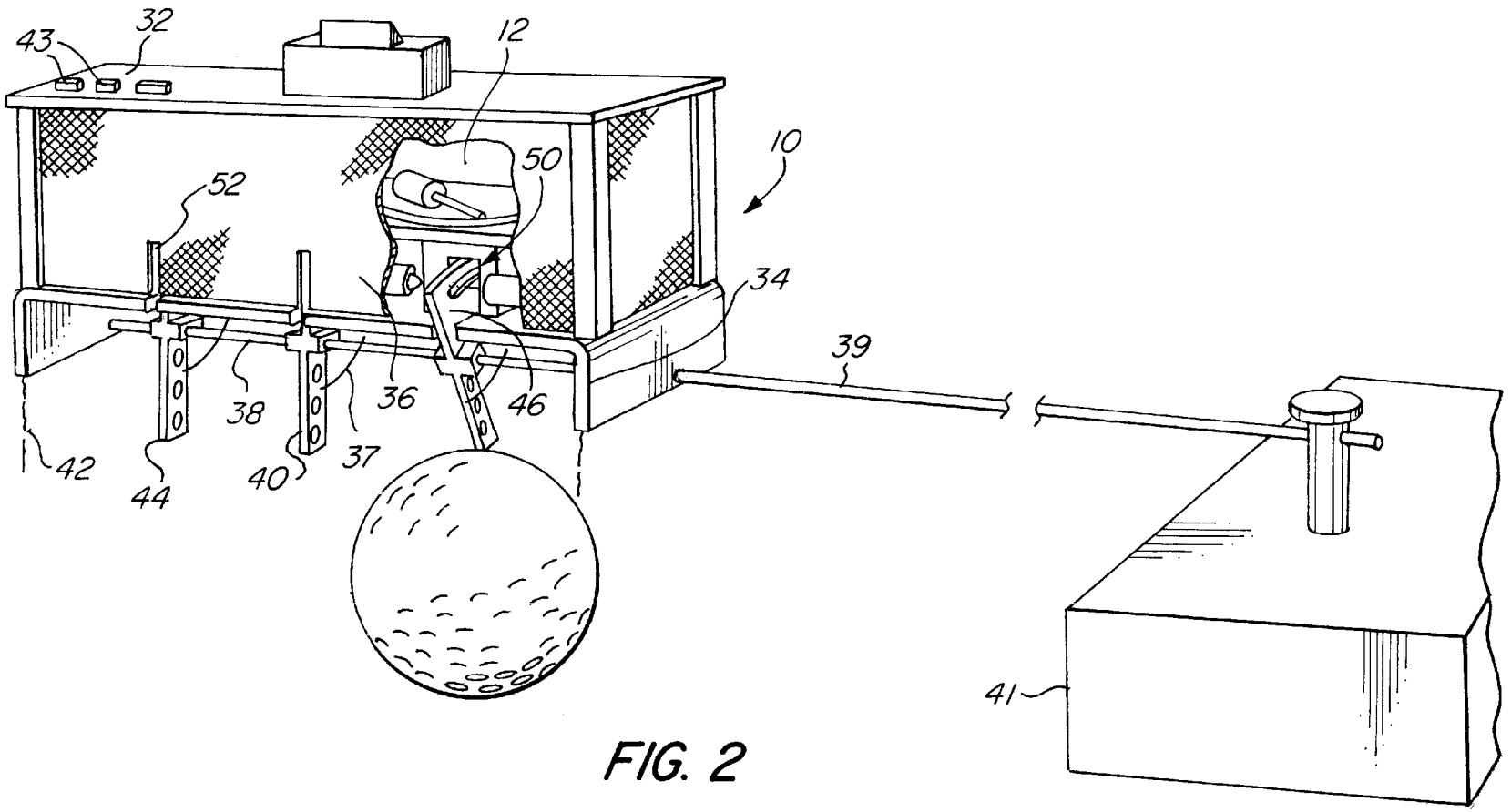
FIG. 2 is perspective view of a device of a putt trainer system carrying out the inventive concept which is illustrated in FIG. 1.

Referring to FIGS. 2 and 3, the putt trainer system 10 has a housing 32 receiving a series of elongate levers 40 which are rotatably mounted to a shaft 38 traversing a base 34 and whose motion is detected by the sensing unit 12 carried by a panel 36. A number of the elongate levers 40 can vary in accordance with a variety of positions of the ball with respect to an imaginary hole. However, a distance between the levers, and preferably between the side levers and respective end threads 42, is so selected that a golf ball having the standard size necessarily actuates adjacent levers 40 if directed in between them. Thus, if struck by a golf ball, either of the side levers represents the putted ball reaching the hole's periphery, whereas the center lever is indicative of the ball hitting the center of the hole. A combination of center and one of the side levers hit simultaneously indicates a position of the ball corresponding to a partially centered putt.

The housing 36 is suspended on an end of a shaft 39 which has a diameter larger than the diameter shaft 38 and extends to a support 41 reinforcing the entire structure so that it is able to withstand even ferociously putted balls that otherwise would topple the housing. The housing can be very compact and sized so that the golf balls can freely roll under the housing's bottom and has a length not exceeding a few inches, whereas the overall distance between the housing and the support can vary depending on how heavy. the support is. Various electronic components including memories and the like and constituting the sensing, speed control, decoder and display units may be mounted on the panel 36 or housed in a separate unit.

A game can be used by a single player or by a few players taking a turn in putting a golf ball or a predetermined number of balls toward the levers and aiming at the center lever. As the ball hits one or two levers, each of them is set in a pivoting motion that is mechanically limited to prevent a rotational motion which other would be indicative of an undesirably high speed. Each of the levers 40 has an arm 42 extending between a lower end 44, which is slightly overweighted to have it always come to rest in a vertical position, and an upper end 46 extending laterally from the arm. The upper end 46 of the lever is guided in a channel 52 of the panel 36 and has an elongated arcuate recess 48 extending in a plane of the lever's trajectory as it displaces due to the impact generated by the putted golf ball. Although the levers are balanced to always return to their initial vertical positions, leaf springs 37 braced between the housing 36 and the levers ensure the return stroke of the levers. Note, the particular shape of the lever, as described, is given only for illustrative purposes and can be changed without, however, deviating from the inventive scope, as is explained herein below.

Figure 3B:
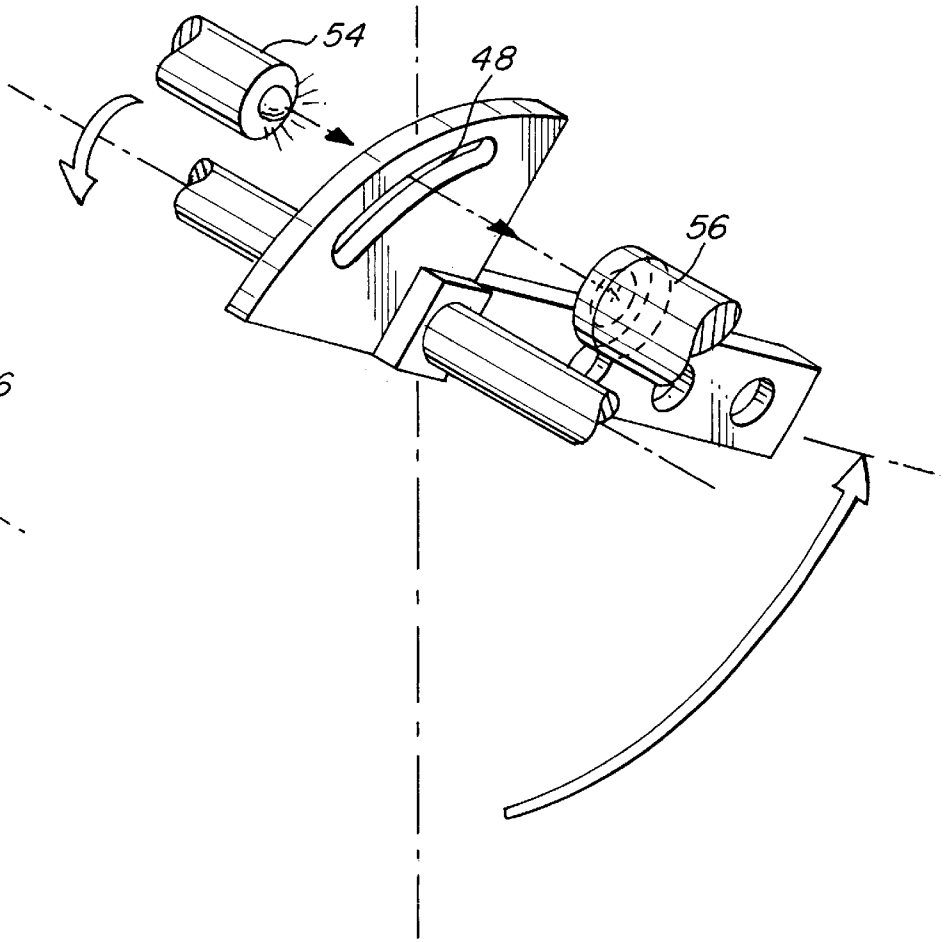
FIG. 3B is a view similar to the one shown in FIG. 3A but illustrating a lever in a deflected position.
Figure 3A:
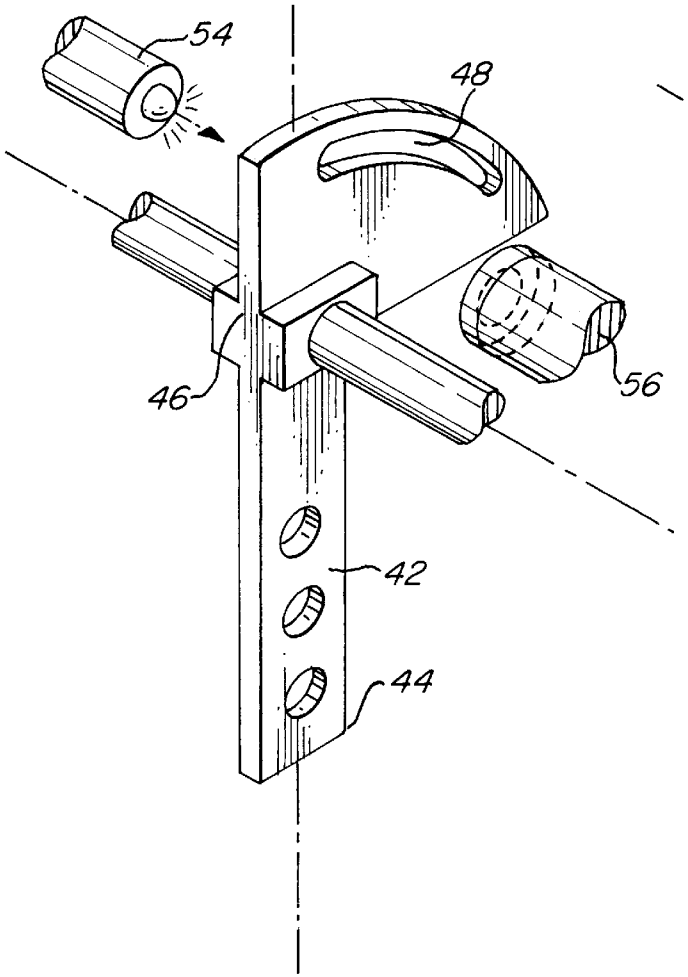
FIG. 3A is a perspective view of a put sensing assembly of the device shown in FIG. 2 showing a lever in a rest position.
Figure 4:
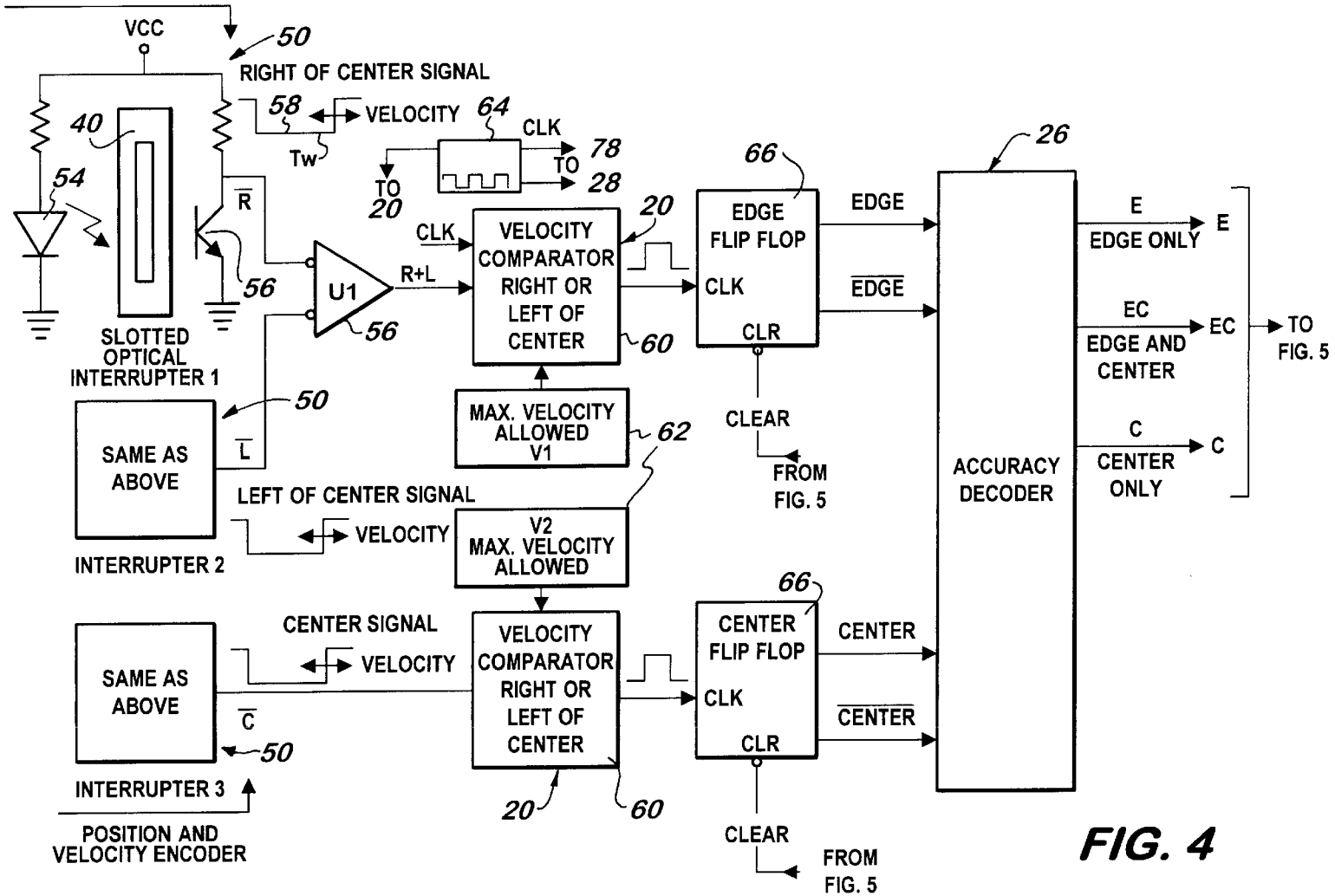
FIGS. 4 and 5 is a circuitry of the device shown in FIG. 2 for evaluating and determining speed and accuracy of a putted golf ball.

In accordance with one aspect of the invention, the ball optical sensors 50 are mounted on the panel 32 to cooperate with levers 40 deflected upon impact with the putted ball. Particularly, each of the ball sensors includes a source 54, such as a LED, generating a light beam and mounted on one of the walls of the channel 52 (FIG. 2) and a detector 56 sensing the light beam in a deflected position of the lever. Specifically, the recess 48 is so sized that the upper end 46 of the lever 40 blocks the light beam from the source 54 in a rest position, shown in FIG. 3A, wherein the lever generally extends in a vertical plane. As the lever hit by the putted ball pivots about the shaft 38, as shown in FIG. 3B, the recess displaces past the light beam allowing it to penetrate through so the sensor 56, such as a phototransistor can detect the light beam. As a consequence, the phototransistor generates at the output of the activated optical sensor or interrupter 50 a negative pulse 58 labeled R(not), L(not) and C(not) and corresponding to the left of center, right of center and center signals, respectively, as shown in FIG. 4. The duration of the pulse, or the pulse width Tw, is equal to the time it takes for the recess to pass by the light beam and can be determined based on the following equation:

$$Tw=L/V, \quad (1)$$

wherein Tw is the pulse width, L is a slot length, and V is an average ball velocity.

From Equation 1 it is seen that the pulse width is proportional to the length of the recess and inversely proportional to the velocity of the ball. In other words, the higher the velocity is, the smaller the pulse width is. This relationship is used to control the outcome of the game by disallowing a score under certain conditions, as will be explained hereinbelow.

Referring specifically to FIG. 4, a circuitry of the putt trainer system is shown in a rather diagrammatic form. Although the left and right optical sensors are logically combined in one circuitry, it is understood that each of them can have its own electronic implementation by simply duplicating what is shown in the figure. Particularly, the left and right optical sensors are ORed by the OR gate 56 to generate a putting detection signal R+L, which indicates that the putted ball has struck either the left or right lever 40 activating, thus, the respective optical sensor 50. If, however, the putted ball struck the center lever, a putting detection signal is generated at the output of the center optical sensor.

Each detection signals is further evaluated by a respective velocity controller 20 having a velocity comparator 60 which determines if the velocity of the putted ball is at most equal to a pre-set reference value $V_1$ at 62. Preferably, the reference value $V_1$ corresponds to an empirically determined maximum velocity at which the golf ball putted at a golf course would probably fall in the hole even if it ran along the periphery of the hole. Thus, despite the fact that the putted ball is somewhat misguided, it still can hit the hole provided the ball's momentum is not high enough to propel it beyond the hole. If the determined velocity does not exceed the reference value, an enabling signal is outputted for further evaluation, as will be explained herein below. If the determined velocity exceeds the reference value, the signal processing is terminated, and the score is disallowed. Analogously, the velocity controller processing a detection signal which is output by the optical sensor in response to striking the center lever evaluates this signal by comparing it with a reference value $V_2$ which may be the same as or somewhat different from the reference value $V_1$. Preferably, $V_2$ is higher than $V_1$.

As mentioned above, both velocity controllers are similar and can be used in various ways. Preferably, the putt trainer system is so constructed that it has at least one counter 62 that can be pre-set by a player to a binary number N, which is selected in accordance with the explanation given hereinbelow. The counter can be set by a clock signal CLK of a clock generator 64 whose frequency $F_{CLK}$ can be conveniently selected, as is well known in the art.

In accordance with the inventive aspect of the invention, if the counter reaches a count of zero at any time during the count down time corresponding to the width of the negative impulse Tw, the velocity comparator will output a terminal count pulse. The terminal pulse corresponds to an enabling signal indicating that the velocity of the sensed putted ball is at most equal to the pre-set reference value $V_1$ and/or $V_2$. Thus, if a struck lever 40 is deflected at a rate enabling the light beam to still penetrate through the recess at the time when the count terminates, then the ball's velocity is adequate which translates into a high possibility of hitting the hole at the golf course. As a consequence, the slotted lever in accordance with the invention provides both the accuracy and velocity information.

To mathematically implement the inventive concept, a count C of the counter at the time of expiration of the negative pulse Tw should be calculated as follows:

$$C=N-F_{CLK}(T_W) \tag{2}$$

wherein N is the binary number and $F_{CLK}$ is the frequency of the clock generator. Using the above-discussed Equation 1, the count will be calculated as follows:

$$C=N-F_{CLK}(L/V) \tag{3}$$

Thus, a terminal count or count of zero generating the enabling signal and indicating the acceptable velocity of the putted ball occurs only if $F_{CLK}(L/V) \geqq N$. Conversely, if $F_{CLK}(L/V)<N$, the count C will not reach zero and the putt will not be scored, because the velocity controller will not generate a pulse, indicating thereby that the ball's velocity is above the reference value.

As stated earlier, the clock frequency $F_{CLK}$ is selectable as is the length of the recess L, so for any given fixed $F_{CLK}$ and L, the only variable is velocity V of the putted ball. The reference value which is preferably the a maximum velocity of the ball for which a center or a periphery hit is allowed can be experimentally determined on the golf course. From the above, N is calculated as:

$$N=F_{CLK}(L/V\text{ref.val}), \tag{4}$$

wherein Vref.val is the desirable speed of the putted ball at the time it strikes one of the levers. As mentioned before, the desirable velocity is the maximum one. Thus, regardless of a distance traveled by a putted ball, if its velocity is at the desirable level, then it most likely will be holed on the golf course. Practicing the put with the inventive trainer system can help a golfer develop a sense of speed at which the club touches the ball at different distances from the levers 40.

In addition to the maximum acceptable velocity, a minimum velocity of the putted ball below which it will likely come to a stop in the vicinity of the hole's periphery can be calculated. Different reference values within a range defined between the known upper and lower limits can be set as well if the sense of velocity is desired to be sharpened even further.

Thus, upon presetting the down counter with the calculated binary N, the clock generator starts driving the counter with the selected frequency $F_{CLK}$. Once the counter is enabled by the detection signal, it will start counting down from its initial count N at the selected frequency and keep doing so for the duration of pulse Tw. The counter is automatically pre-set to the number N and is ready for the next event either when the count terminates during the pulse or when the score is annulled.

According to one feature of the invention, the slot of the central lever, which is preferably 0.400' long, is somewhat greater than either of the side lever's slots, each of which is 0.345" long. As a result a countdown time period is selected to be the same for all levers. It should be understood, that the velocity information can be obtained modifying the above-described structure by providing all levers with the uniformly sized slot and by selecting different countdown periods for center and side putts. Such selection can be easily implemented by activating a plurality of activating switches 43 that are provided, for example, either on the housing, as shown in FIG. 2, or on a separate control unit (not shown).

Turning back to FIG. 4, the enabling signal generated by the velocity comparator 60 actuates one of a plurality of flip-flops 66, each connected in series with the respective velocity controller 20. The flip-flop serves as a switch having a capacity of storing the event, which, in this case, is the putting signals corresponding to activation of one of the side ball sensors, the center ball or the center and side ball sensors simultaneously.

The signals form the flip-flops 66 are then fed to the accuracy decoder 26 using combinatorial logic which consists of a plurality of OR gates determining he accuracy of the putt in the known manner. The accuracy decoder 26 generates at its output discrimination signals E, EC, and C corresponding to off-centered, partially centered and centered, putts that are detected by the side, side and center, and only center ball sensors, respectively.

Figure 5:
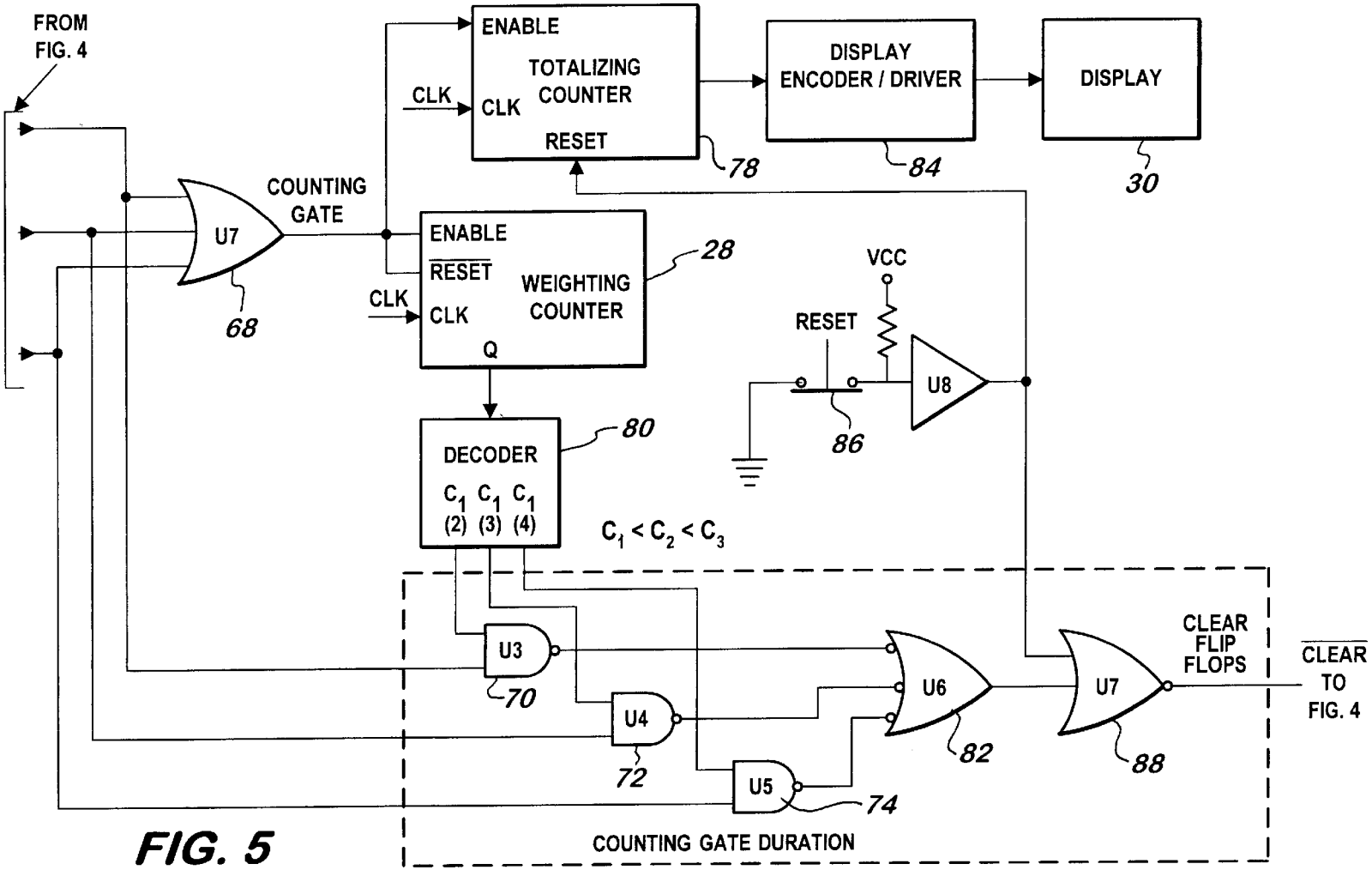

Referring to FIG. 5, the discrimination signals are further digitally ored by another logic circuit including an OR gate 68 whose input is connected with inputs of AND gates 70, 72, and 74 as will be explained herein below. The OR gate 68 generates a counting gate signal at its output in response to one of the discrimination signals from the decoder 26 to enable a weighting counter 76 that is capable of determining the duration of counting signal. As the name implies, in order to discriminate between the signals representing accuracy of the detected putt, the duration of counting gate signal varies to represent the off-centered, partially centered, and centered putts. The counting gate signal is fed to the weighting counter 38 counting the duration of this signal to further determine an accuracy of the sensed putt. Simultaneously, the counting gate signal is delivered to an input of a totalizing counter 78 counting the number of clock cycles in order to determine the score for the sensed putt. Thus, the score allocated to the sensed putt depends on the accuracy of the putt and can be conveniently chosen. Given only by way of example, a score of 2 is allowed for an off-centered putt, 3 for a partially centered putt, and 4 for a center putt.

A count of the weighting counter corresponding to the duration of the counting gate signal made in a binary form is decoded by a binary to decimal decoder 80. Each of the outputs of the AND gates 70, 72, and 74 becomes active only if both the discrimination signal E, EC, and C and counts 2, 3, and 4, respectively, are fed to the appropriate gate. Thus, the gate 70 outputs a signal when the E signal is active and the count is 2, the gate 22 when the EC signal is active and the count reaches 3, and the gate 74 generates an output signal upon receiving the C signal and the count of 4.

The outputs of the gates 70, 72, and 74 are next logically combined by another OR gate 82. This OR gate 82 generates an output, which is subsequently inverted by an inverter 88 generating the CLEAR (not) signal that resets the totalizing counter and all the flip-flops. Therefore, the weighting counter 78 is stopped and cleared while the counting gate 68 is stopped when any of the three AND gates becomes active. The totalizing counter count is decoded by a display encoder 84 and appears on the display 30. At this point of time the putt trainer system is ready for evaluating a subsequent putt.

If at any time during a game, a player or players wish to reset the system and start anew, a switch 86 conveniently positioned on the housing or in any other easily reachable location automatically resets the electronic circuit.

From the foregoing, it will be seen that this invention provides a simple, inexpensive, compact and effective device for learning and/or improving a putting swing.

Many possible changes, modifications and embodiments may be made of the invention without departing from the scope thereof ads define in the appended claims.

What is claimed is:

1. A putting trainer comprising:

a housing having a bottom;

a stabilizing support spaced from the housing;

a rod mounted to the housing and to the stabilizing support;

a controller evaluating the accuracy of putt and including:

at least three sensors detecting centered, partially centered and off-centered putts, respectively, each of the sensors having a respective sever pivotally mounted of the rod to pivot to a detecting position upon getting hit by a ball, so that the three levers are spaced apart at a distance less than a diameter of the ball and arranged in a row, and generating a respective detection signal, an accuracy decoder for decoding said detection signals and generating discrimination signals representing centered, partially centered and off-centered putts, and a weighting counter weighting the discrimination signals with predetermined weighting factors, each representing the centered, off-centered and partially centered putts to obtain a score, and a totalizing counter determining a duration of each of the discrimination signals representing a respective score assigned to each discrimination signal while it is being weighed, and a display indicating the score representing the centered, partially centered and off-centered putts.

2. The putting trainer defined in claim 1 wherein each of the levers has an upper end formed with a slot of a predetermined length, a source of light generating a light beam intercepted by the lever in its rest position, and a detector generating the respective detection signal in response to light passing through the slot as the lever is displaceable from the rest position upon being hit by the ball.

3. The putting trainer defined in claim 2 further comprising a speed controller comparing a speed of the putted ball with a reference value and nullifying the score if the speed exceeds the reference value.

* * * * *